United States Patent [19]

Miram et al.

[11] Patent Number: 4,873,468

[45] Date of Patent: Oct. 10, 1989

[54] MULTIPLE SHEET BEAM GRIDDED ELECTRON GUN

[75] Inventors: George V. Miram, Atherton; Michael C. Green, Palo Alto; George K. Merdinian, Los Altos, all of Calif.

[73] Assignee: Varian Associates, Inc., Palo Alto, Calif.

[21] Appl. No.: 194,638

[22] Filed: May 16, 1988

[51] Int. Cl.[4] ..... H01J 33/04; H01J 29/58; H01J 19/04

[52] U.S. Cl. ..... 313/411; 313/420; 313/448; 313/452

[58] Field of Search ..... 313/447, 448, 452, 453, 313/411, 420, 346 DC

[56] References Cited

U.S. PATENT DOCUMENTS

| | | | |
|---|---|---|---|
| 2,883,576 | 4/1959 | Harries | 313/411 X |
| 3,119,041 | 1/1964 | Harris | 313/304 X |
| 3,440,466 | 4/1969 | Colvin et al. | 313/420 X |
| 4,061,944 | 12/1977 | Gay | 313/420 |
| 4,147,953 | 3/1979 | Esterson | 313/454 X |

*Primary Examiner*—Palmer C. DeMeo

*Attorney, Agent, or Firm*—Stanley Z. Cole; Gerald M. Fisher; Kenneth L. Warsh

[57] ABSTRACT

A gun for generating a multiple sheet beams 50 of electrons has a flat surfaced cathode 10 with parallel protruding ridges 12 of non-emitting material forming parallel focus electrodes for the sheet beamlets. A control grid of parallel bars 14 is aligned with the ridges 12 to reduce grid interruption. The beamlets may be focussed between support bars 54 of a foil anode 52 for passing the beam into a high-pressure volume such as a gas laser 48. The ridges are formed by inserting non-emissive bent sheets into grooves 58 in the cathode, which are dovetailed to hold them.

11 Claims, 3 Drawing Sheets

FIG. 2
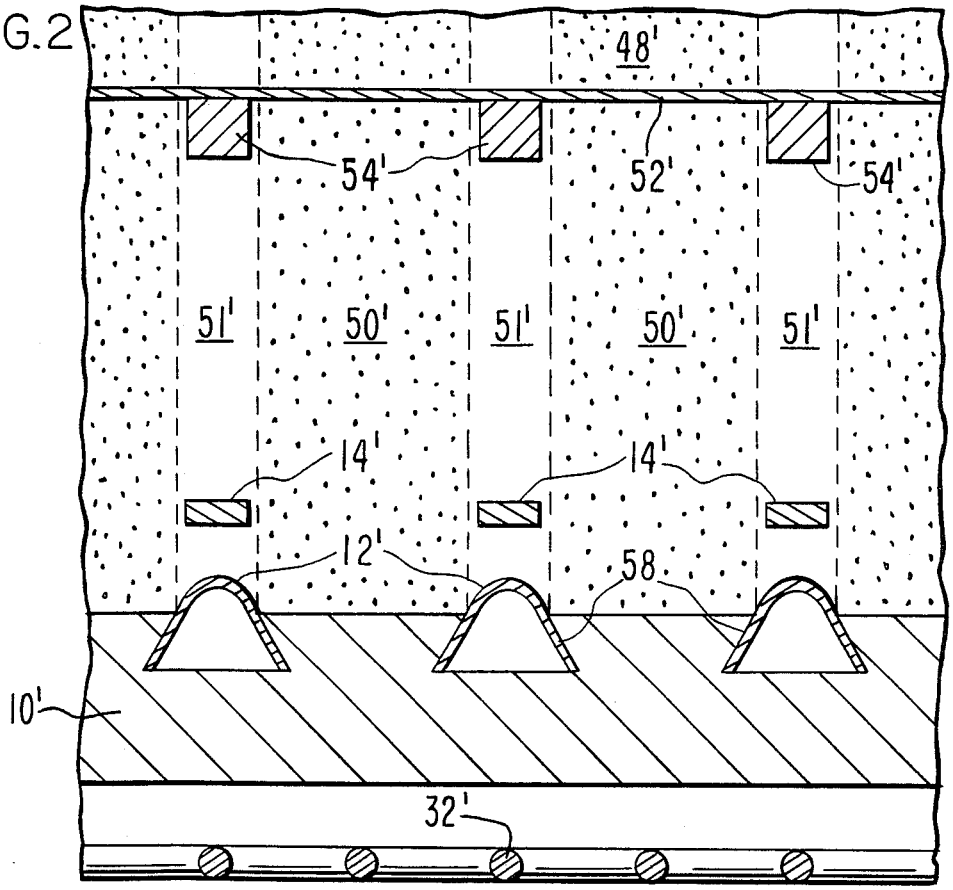
FIG. 3
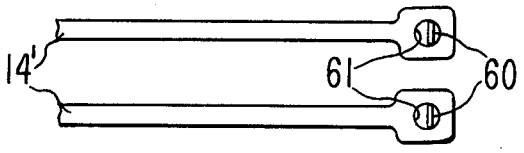
FIG. 5
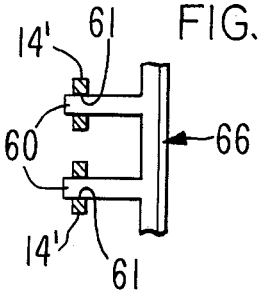
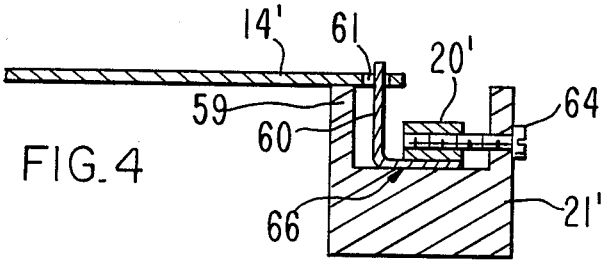
FIG. 4

MULTIPLE SHEET BEAM GRIDDED ELECTRON GUN

FIELD OF THE INVENTION

The invention pertains to electron beams suitable for excitation of high-power gas lasers. For this purpose the high-voltage beams are generated in a high-vacuum source and propagated through a thin metal foil into the gas laser envelope. Heating of the foil forms a limit to the available power.

PRIOR ART

In high-current electron guns the control grid is positive with respect to the cathode when beam current is drawn. Electrons intercepted by the grid heat it, limiting the current capability. There have been many attempts to make grids non-intercepting by focusing the electrons into many small beamlets passing through the openings between grid conductors.

U.S. Pat. No. 3,558,967 issued Jan. 26, 1971 to G. V. Miram discloses an array of concave depressions in the emitting surface to focus beamlets through apertures in the grid mesh. The emission from the cathode areas between the apertures is reduced by a non-emissive coating or a "shadow grid" on or embedded in the cathode surface.

U.S. Pat. No. 3,967,150 issued June 29, 1976 to Erling L. Lien, George V. Miram and Richard B. Nelson describes methods of fabricating non-emissive areas by selective deposition and removal of areas of emissive coating.

U.S. Pat. No. 4,096,406 issued June 20, 1978 to George Valentine Miram and Erling Louis Lien shows an insulating layer bonded to a conductive grid layer on the side opposite the cathode and a barrier layer on the other side, with holes for beamlets, bonded to the cathode surface.

U.S. Pat. No. 4,263,528 is an improvement with addition of a non-emissive layer on the grid surface.

SUMMARY OF THE INVENTION

An object of the invention is to provide a beam gun for projecting a beam through a foil with minimum heating of the foil which minimizes the temperature of the foil.

A further object is to provide a gun with a grid for controlling the beam flow.

A further object is to provide a gun permitting high transmission through the foil structure.

A still further object is to provide a gun which is easy to manufacture.

A still further object is to provide a gun for generating square beams capable of close packing.

These objects are achieved by a gun focusing parallel sheet beams separated by spaces of very low electron current. The thermionic cathode has parallel embedded, non-emissive ridges acting as focusing electrodes for the separated sheet beams. The parallel grid bars are directly in front of the ridges to intercept negligible current. The resulting gaps in electron density may be aligned with parallel bars supporting a metal foil through which the beam leaves the gun. These bars support the foil against outside pressure and also carry off heat generated by the transmission of the high-voltage beam.

BRIEF DESCRIPTION OF THE DRAWINGS

FIG. 2 is an enlarged portion of FIG. 1.

FIGS. 3, 4, 5 are orthogonal views of the grid elements and their supports.

DESCRIPTION OF THE PREFERRED EMBODIMENTS

Figure 1:
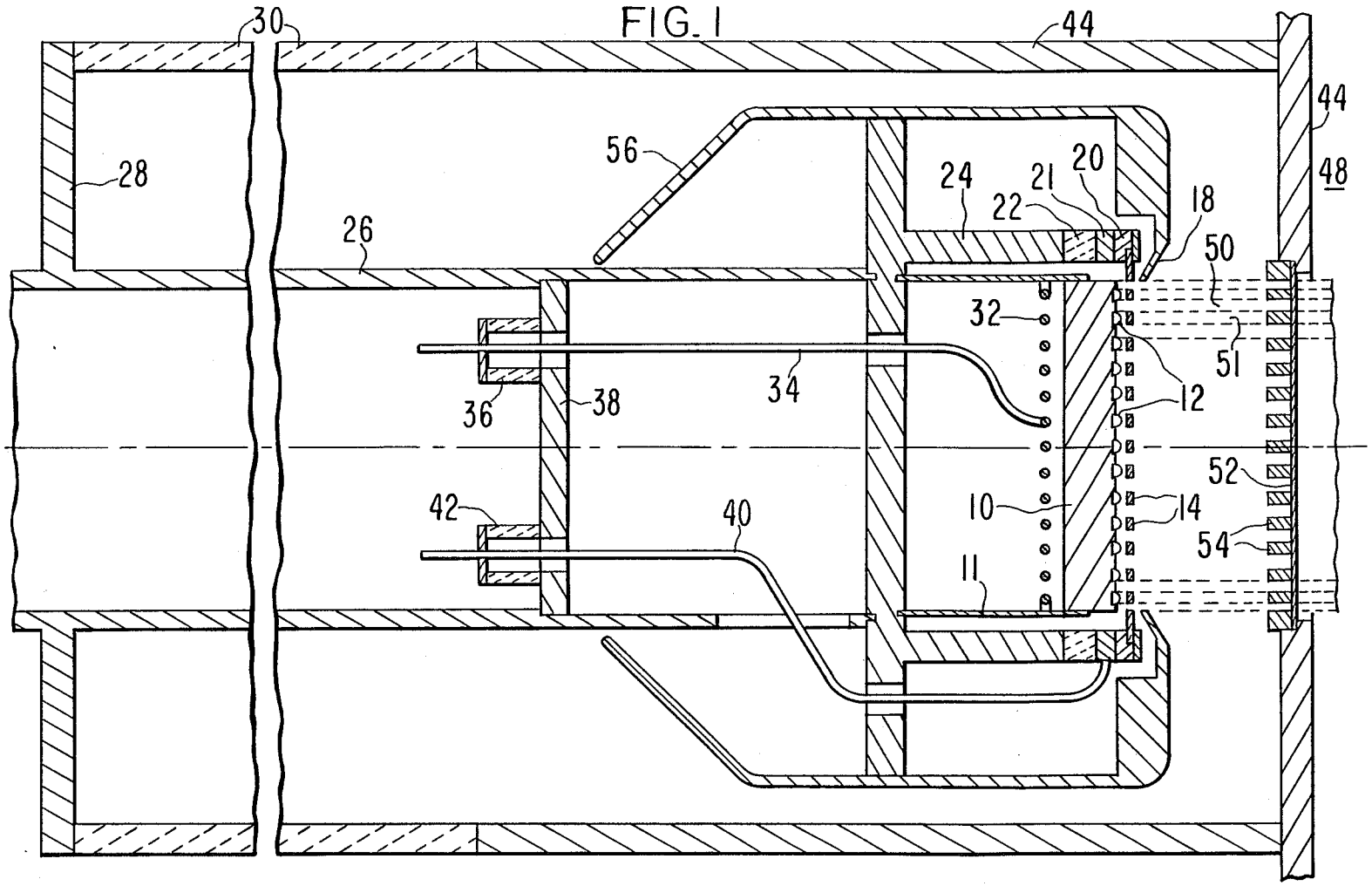
FIG. 1 is a schematic axial section of the inventive gun and the matching vacuum-envelope foil portion of the beam-exit window.

FIG. 1 is a sketch of a cross-section of the electron gun. A thermionic cathode 10, as of porous tungsten impregnated with barium aluminate, is supported on a thin metallic cylinder 11. Cathode 10 emits an array of parallel sheet beamlets of electrons 50 separated by gaps 51 where the electron density is very low. To form gaps 51, cathode 10 has an array of parallel protruding ridges 12, to be described later, which act as non-emitting focusing electrodes. In the present embodiment cathode 10 is of square outline. In a presently planned use an array of square beams are packed as closely as possible to excite a large gas laser, so the square shape gives a greater filling factor than could be obtained from cylindrical beams. Immediately in front of cathode 10 is a control grid structure comprising a parallel array of grid bars 14, which may be rectangular as shown or cylindrical wires. Bars 14 are positioned to line up with focusing ridges 12 to minimize interception of beam current and consequent heating.

Surrounding the array of beamlets 50 is a focusing electrode 18 having a square aperture. It operates like the well-known "Pierce electrode" used for cylindrical beams.

Grid bars 14 are supported on a grid mounting member 20 which, by adjusting screw 64 (FIG. 4) is slidable on grid support frame 21 to adjust the tension in grid bars 14 to compensate for thermal expansion, frame 21 is supported by an annular grid insulator 22, as of high-alumina ceramic which in turn is sealed to a support header 24 which also supports cathode 10. Header 24 is mounted via a support stem 26 on an apertured vacuum-envelope plate 28. In the planned application, the array of individual guns will be mounted on one large plate 28 which would be surrounded by a vacuum seal insulator and the whole array operated in the high-vacuum chamber.

Cathode 10 is heated by a radiant coil heater 32, shown as a bifilar spiral to reduce magnetic field. The outer legs of heater 32 are connected to cathode 10. The center is fed from heater lead 34 passing via cylindrical heater insulator 36, through a vacuum envelope plate 38 which seals off support cylinder 26.

Control voltage pulses are applied to grid bars 14 from grid support 20, which is connected to supply lead 40. Lead 40 also exits vacuum plate 38 through an insulating vacuum seal 42 which is longer than low-voltage heater insulator 36.

As shown in the enlarged sketch of FIG. 2, beamlets 50 are kept focussed into flat sheets by an axial magnetic field (not shown). The beams are accelerated toward an anode 52 which is a thin metallic foil as of beryllium or aluminum. The accelerating voltage is of the order of a megavolt so the electrons pass through foil 52 into a gas laser atmosphere 48.

Foil 52 covers apertures in a thick anode plate 46 which is part of the gun vacuum envelope. In the single-gun embodiment of FIG. a metallic vacuum-envelope cylinder 44 extends from anode plate 46, and is sealed to one end of a high-voltage cylindrical insulator tube 30 whose other end is sealed to envelope plate 28.

In operation, anode plate 46 may be at ground potential and the gun structure mounted on plate 28 may be pulsed negatively for short pulses. The beam-current pulses may be very short, of the order of nanoseconds, and controlled by pulsing the voltage between grid 14 and cathode 10. Either electrode may be driven. For the present application cathode pulsing is preferred.

Anode foil 52 is supported by parallel metallic bars 54 which support the foil against the gas pressure in laser chamber 48. Bars 52 also serve to conduct away heat generated in foil 52 by penetrating electrons. Bars 52 are positioned in low-current beam gaps 51 to minimize their own dissipation.

FIG. 2 is an enlarged sketch showing the novel construction of focusing ridges 12'. Dovetail slots 58 are machined in the emitting surface of cathode 10'. For the scale of the presently constructed guns, slots 58 are made by mechanical end-mills. Ridges 12' are metallic strips bent into a rounded-top shape. They preferably have a slight interference fit in slots 58 by using them as springs. For greater security they are welded at their ends to cathode 10. Emission from ridges 12' would produce electrons which would strike grid bars 14'. To prevent this, ridges 12' are coated before assembly in slots 58 with non-emitting material such as titanium, carbon or carbides. The art of emission suppression is well known. Grid bars 14' also may be made non-emissive.

FIGS. 3, 4, 5 are orthogonal views of grid bars 14' and grid support structure 20'. Because bars 14' elongate as they are heated in operation, they are spring-loaded in addition to the tension adjustment described above. Bars 14 are spaced from mounting member 21' by a projecting lip 59. Movable grid support 20' slides on support 21' as controlled by adjusting screws 64. Attached to the bottom of support 20' is a spring strip 66 as of high-speed tool steel with fingers 60 which extend through holes 61 in each grid bar 14'. Grid support 20' is moved to flex fingers 60 while cold and provide tension. As grids 14' expand in operation the return of springs 60 maintains tension.

Figure 6:
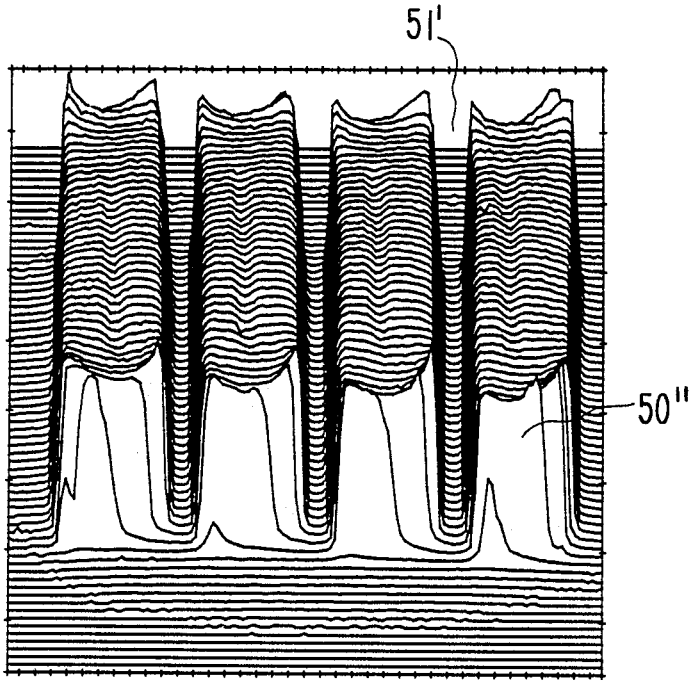
FIG. 6 is a tracing of measurements of the beam current distribution.

FIG. 6 is a tracing of measured beam current density profiles through the multi-sheet electron beam. Density is plotted vertically versus distance across the beamlets horizontally, as measured by an automatic sampler apparatus. Profiles at stepped intervals away from the cathode are displaced vertically to provide a perspective of the 3-dimensional variations. The cathode is above the picture.

Figure 7:
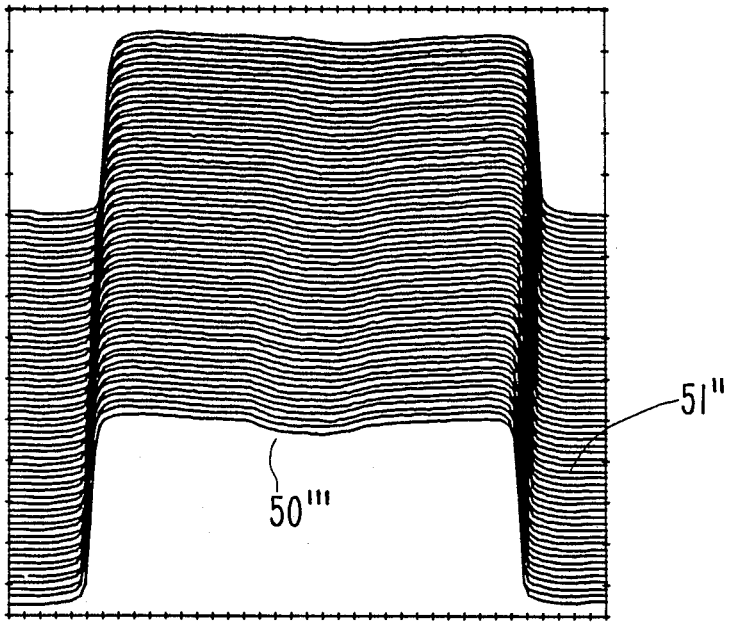
FIG. 7 tracing of beam current in a single sheet beam.

FIG. 7 is a similar tracing on an enlarged scale for a single beamlet. The larger scale smooths out some of the "noise" in FIG. 6.

The above described gun is based on a preferred embodiment developed for a particular application. The invention may be used in many other embodiments for other uses which will become apparent to those skilled in the art. For example, structures adapted for high-frequency modulation will have much closer spacings. The scope of the invention is to be limited only by the following claims and their legal equivalents.

What is claimed is:

1. A gun for projecting multiple sheet electron beams comprising:

a thermionic cathode with a extended emissive surface;

a set of parallel focusing bars, each focusing bar comprising a base portion held in a slot in said extended surface and a focusing portion projecting as a ridge above said surface; and a grid of conductive bars uniformly spaced above said ridges and aligned therewith.

2. The gun of claim 1 wherein the outer surfaces of said ridges meet said emissive surface at an obtuse angle.

3. The gun of claim 1 wherein said focusing bars are metallic sheets formed with legs to fit the sides of said slots.

4. The gun of claim 1 wherein said slots are wider at their bottoms that at said emissive surface and the base portions of said bars are shaped to fit said slots.

5. The gun of claim 4 wherein said slots are dovetail shapes.

6. The gun of claim 1 wherein the outer surfaces of said focusing portions are non-emissive material.

7. The gun of claim 1 wherein said ridges are shaped to focus said beams between said grid bars.

8. The gun of claim 1 wherein said grid bars are supported on at least one end on a common support member movable to adjust tension in said grid bars.

9. The gun of claim 8 wherein said support member comprises individual spring elements for supplying tension in said grid bars.

10. The gun of claim 1 further including an anode comprising an electro-permeable metallic foil supported by parallel bars.

11. The gun of claim 10 wherein said ridges are parallel with and align with said anode bars and shaped to focus said beams between said anode bars.

* * * * *